US009162367B2

(12) United States Patent
Williams et al.

(10) Patent No.: US 9,162,367 B2
(45) Date of Patent: Oct. 20, 2015

(54) COVE SYSTEM

(75) Inventors: Ted Williams, Tucson, AZ (US); Brian Kelly, Tucson, AZ (US)

(73) Assignee: The New Guilds, LLC, Tucson, AZ (US)

( * ) Notice: Subject to any disclaimer, the term of this patent is extended or adjusted under 35 U.S.C. 154(b) by 316 days.

(21) Appl. No.: 13/572,272

(22) Filed: Aug. 10, 2012

(65) Prior Publication Data

US 2014/0041494 A1 Feb. 13, 2014

(51) Int. Cl.
*B27B 27/08* (2006.01)
*B27B 31/06* (2006.01)

(52) U.S. Cl.
CPC ..... *B27B 27/08* (2013.01); *B27B 31/06* (2013.01); *Y10T 83/04* (2015.04); *Y10T 83/728* (2015.04)

(58) Field of Classification Search
CPC ..... B27B 27/02; B27B 25/10; B27B 5/38; B27B 27/10; B27B 27/08; B27B 5/243; B27B 5/222; B27B 13/14; B27B 5/32; B27B 27/04; B27B 27/06; B27B 5/29; B27B 25/00
USPC ..... 33/640; 83/13, 439
See application file for complete search history.

(56) References Cited

U.S. PATENT DOCUMENTS

| | | | | | |
|---|---|---|---|---|---|
| 5,289,861 | A * | 3/1994 | Hedrick | 144/135.2 |
| 5,379,669 | A * | 1/1995 | Roedig | 33/641 |
| 5,845,410 | A * | 12/1998 | Boker | 33/536 |
| 6,073,532 | A * | 6/2000 | English | 33/640 |
| 6,532,679 | B2 * | 3/2003 | Cole | 33/640 |
| 6,536,124 | B1 * | 3/2003 | Eskew et al. | 33/471 |
| 6,604,296 | B2 * | 8/2003 | Mastrobattista | 33/640 |
| 6,776,076 | B2 * | 8/2004 | Salazar | 33/471 |
| 7,341,081 | B1 * | 3/2008 | Villiger | 144/253.8 |
| 7,421,798 | B2 * | 9/2008 | Pattee | 33/640 |
| 8,752,459 | B1 * | 6/2014 | Koresh | 83/13 |
| 2001/0034951 | A1 * | 11/2001 | Sears | 33/640 |
| 2002/0023365 | A1 * | 2/2002 | Cole | 33/640 |
| 2006/0201298 | A1 * | 9/2006 | Smith | 83/468 |
| 2008/0178486 | A1 * | 7/2008 | Pattee | 33/640 |
| 2011/0061508 | A1 * | 3/2011 | Scherl | 83/438 |
| 2011/0296968 | A1 * | 12/2011 | Doumani | 83/468.2 |
| 2011/0314986 | A1 * | 12/2011 | Doumani et al. | 83/471.2 |
| 2014/0041494 | A1 * | 2/2014 | Kelly et al. | 83/13 |

* cited by examiner

*Primary Examiner* — Yaritza Guadalupe-McCall
(74) *Attorney, Agent, or Firm* — Nikia L. Gray; Quarles & Brady LLP

(57) ABSTRACT

A system and a method of using the system for reproducibly cutting a cove using a table saw are presented. The system comprises a first fence assembly and a fixturing means, where the fence assembly is rotatably affixed to the fixturing means, wherein the fixturing means can be releasably secured to the table of the table saw. The method comprises providing a blank molding, a table saw having a table and saw blade, and the cove system and releasably affixing the cove system to the table. The method further comprises setting a fence angle using the first fence assembly and setting a fence depth by adjusting the position of the fixturing means with respect to the table. The method finally comprises feeding the blank molding over the saw blade thereby cutting a cove in the blank molding.

13 Claims, 18 Drawing Sheets

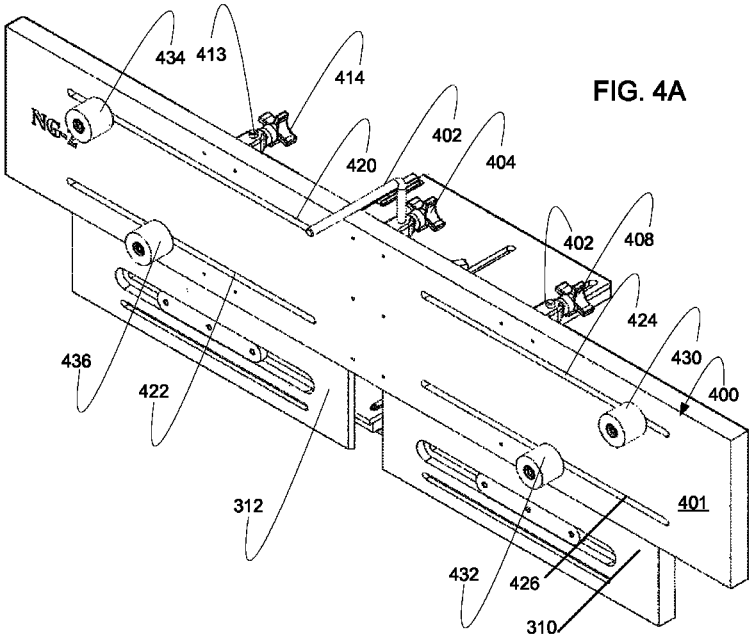
FIG. 4A
FIG. 4B
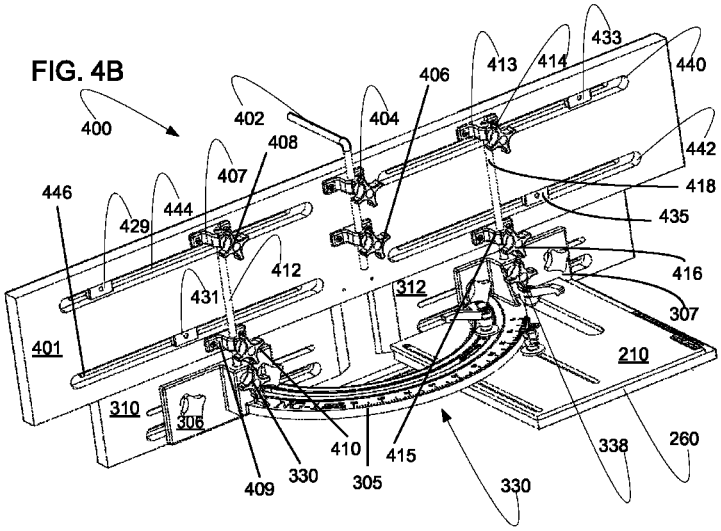

COVE SYSTEM

FIELD OF REFERENCE

The present application relates to a device for making cove and associated moldings.

BACKGROUND

A cove molding has a concave-profile and is often used at the junction of an interior wall and ceiling, on furniture, and for picture frames for art, though it is often used as a design element in various other applications. Because of its elegant look, cove molding is a favorite of architectural and other professional designers. However, the prior art methods of making a cove molding on a table saw requires complicated, and sometimes unsafe, set-ups which are difficult to reproduce if additional molding is needed at a later time. The most common prior art method involves clamping a board or other straight-edged material to the table saw with the blade raised to the cove final cut height and adjusting this fence's location by trial and error. The saw blade is then lowered to just above the saw table surface. Using the auxiliary fence to position the molding blank, the cove is formed by making multiple passes of the molding blank over the saw blade, each time raising the blade approximately 1/16" until the final cove depth and width are achieved. In actual practice, the first problem encountered is the structure of the underside of a saw's table casting. Either it is cast as a ribbed item, or it may be cast with other features that impede secure clamping of the fence. Also, clamping at the front of the saw table must accommodate the variation from the top of the saw table to the top of the fence guide rail which is lower than the table top. Many older table saws use a round bar as the fence guide rail, which further complicates clamping by requiring a V-block and other fixturing. The back of many saw tables has little or no area sufficient for solid clamping of the trailing edge of the temporary fence. Also, any adjustment of the fence requires re-setting the clamping, blocking, and shimming at both the front and the back of the saw table.

To cut an open cove molding, where the cove is cut only on the front portion of the blade, involves a cumbersome process requiring lowering the blade, placing the fence above the blade, turning the saw on, raising the blade to the height of the cove cut, cutting through the fence in the process, and performing a test cove run. If further adjustment is required, all the steps must be repeated for each adjustment, and with each adjustment another cut is introduced to the fence. This cumbersome, time consuming process discourages most woodworkers. Additionally, reproducing a previously produced molding in the future requires going through all the above steps again.

Jigs utilizing a parallelogram design for producing straight housed coves of limited width and depth are commercially available. Within this narrow range such jigs perform reasonably well, but often in architectural and furniture crafts, open and housed profiles are required in a flat and vertical orientation, and often require matching inside and outside curved profiles in both horizontal and vertical orientations. Such commercially available jigs are not able to produce such coves. To achieve these alternative coves even in large industrial shops requires many different machines and specialized tooling, thus making them expensive and impractical.

SUMMARY

What is needed is a system and method for producing cove molding that is easily set up on any table saw, and is accurate repeatable, and safe to use.

A system for reproducibly cutting a cove using a table saw is presented. The system comprises a first fence assembly and a fixturing means, where the fence assembly is rotatably affixed to the fixturing means, wherein the fixturing means can be releasably secured to the table of the table saw.

A method of reproducibly cutting coves using a table saw is also presented. The method comprises providing a blank molding, a table saw having a table and saw blade, and a cove system having a first fence assembly and a fixturing means, wherein the fence assembly is rotatably affixed to the fixturing means and wherein the fixturing means can be releasably secured to the table, and releasably affixing the cove system to the table. The method further comprises setting a fence angle using the first fence assembly and setting a fence depth by adjusting the position of the fixturing means with respect to the table. The method finally comprises feeding the blank molding over the saw blade, as the saw blade is incrementally raised with each pass, thereby cutting a cove in the blank molding, in either horizontal or vertical configurations, for open or housed profiles, as well as inside and outside radii and vertical radius configurations.

BRIEF DESCRIPTION OF THE DRAWINGS

Implementations of the invention will become more apparent from the detailed descriptions set forth below when taken in conjunction with the drawings, in which like elements bear like reference numerals.

FIG. 4A depicts an embodiment of Applicants' cove system with an additional auxiliary fence assembly and support rollers for running large scale vertical cove moldings;

FIG. 4B depicts the mounting system for the auxiliary fence to the cast fence assembly of FIG. 4A;

DETAILED DESCRIPTION OF THE PREFERRED EMBODIMENTS

This invention is described in preferred embodiments in the following description with reference to the Figures, in which like numbers represent the same or similar elements. Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

The described features, structures, or characteristics of the invention may be combined in any suitable manner in one or more embodiments. In the following description, numerous specific details are recited to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

The schematic flow charts included are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

Figure 8A:
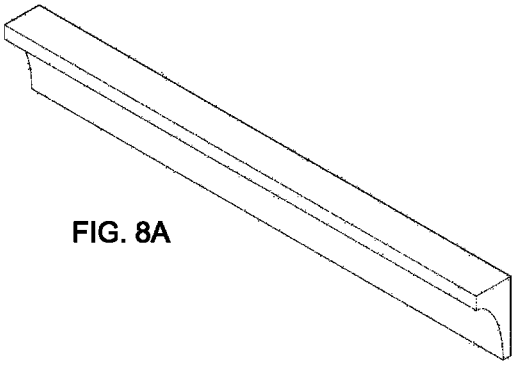
FIG. 8A depicts a straight cove molding produced using Applicants' cove system.
Figure 8B:
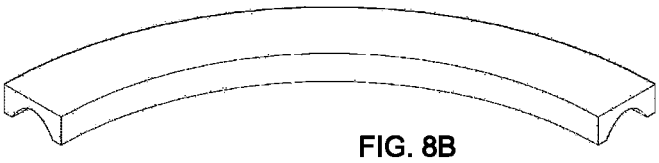
FIG. 8B depicts a curved housed cove molding produced using Applicants' cove system.
Figure 8C:
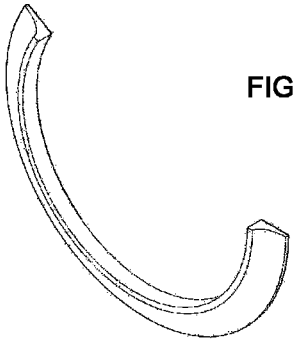
FIG. 8C depicts a deep profile cove molding produced using the auxiliary fence system.
Figure 8D:
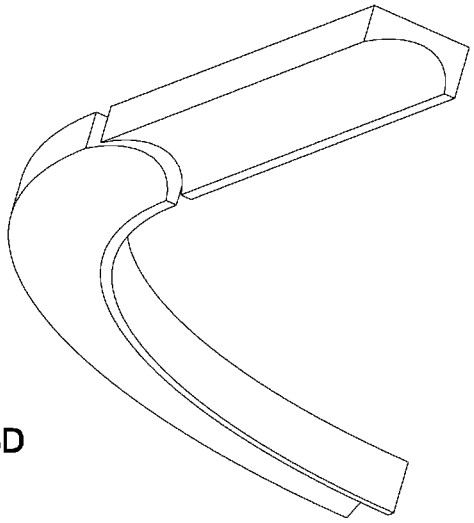
FIG. 8D depicts a molding produced by matching a radiused section with a straight section using Applicants' cove system by tilting the blade to offset the difference equal to the distance between bisecting the length of saw blade above the table and the radius being run.
Figure 8E:
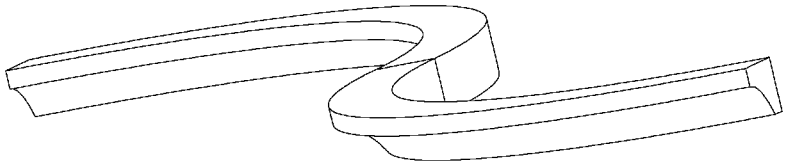
FIG. 8E depicts a serpentine molding produced using the Applicants' cove system by splitting in half a curved, housed cove molding, such as depicted in FIG. 8B, and reversing them end-to-end.

Applicants' invention comprises a system and method of creating and reproducing open cove and housed cove molding. An illustration of a straight cove is provided in FIG. 8A. A curved housed cove molding is shown in FIG. 8B. Large or deep, as well as asymmetrical or parabolic, profile moldings, such as shown in FIG. 8C, can also be produced using Applicants' cove system. Further, Applicant's cove system can be used to produce a serpentine molding as shown in FIG. 8E or a mixed shaped molding as in FIG. 8D.

Applicants' cove system is easy to understand and implement and, as will be discussed further, is based on a four variable matrix: blade height, fence angle, fence depth, and fence offset. A fifth variable, blade angle, is introduced for the production asymmetric or parabolic moldings and is used in some conditions in matching a curved molding to a straight molding. Through various settings, a number of cove moldings can be produced safely, accurately, and with a considerable time savings over the prior art.

In addition to creating straight moldings, Applicants' cove system provides the means for creating curved moldings in both the X and Z axis orientations. As will be appreciated by one of ordinary skill in the art, prior art methods of making such curved moldings required the use of heavy industrial equipment and tooling costing hundreds of dollars per profile shape. Applicants' cove system therefore provides an advantage over the prior art in terms of both cost and ease of use. Furthermore, Applicants' cove system does not need to be removed from the table saw to use the saw for traditional machining operations.

The figures provided show Applicants' cove system in a right handed orientation. One skilled in the art will appreciate that Applicants' cove system can be used in a left handed orientation and such use is within the scope of the present invention. To use Applicants' cove system in a left handed orientation, the system is simply rotated and affixed to the table saw in the opposite direction.

Figure 1A:
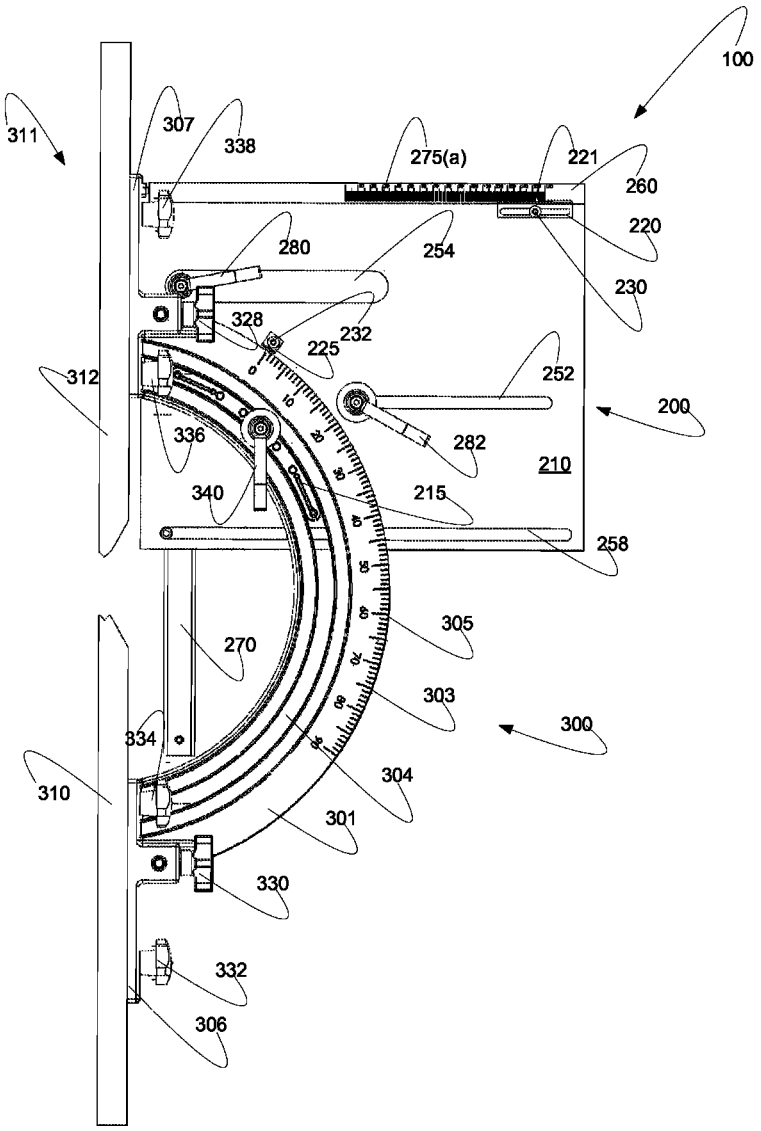
FIG. 1A depicts an embodiment of Applicants' cove system configured to allow the production of housed and open coves in vertical and horizontal orientations.
Figure 1B:
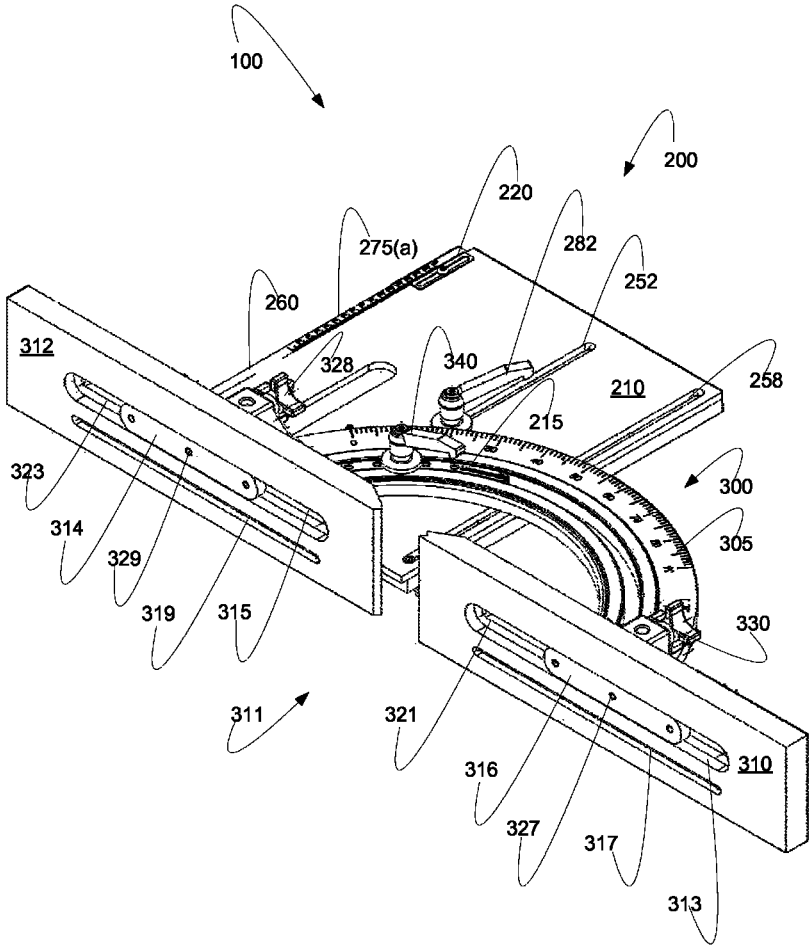
FIG. 1B depicts an alternate view of Applicants' cove system shown in FIG. 1A.

Turning now to FIGS. 1A and 1B, the components of Applicants' cove system 100 will first be discussed followed by a description of it's operation. As can be seen in the illustrated embodiments, of FIGS. 1A and 1B, Applicants' cove system 100 comprises fence assembly 300 and a means for fixturing fence assembly 300 to a table saw such as X-Y plate assembly 200, comprised of X-plate 210 and Y-plate 260. In certain embodiments, plate assemblies other than plate assembly 200 are used to fixture cove system 100 to a router table. By way of example and not limitation, a single plate may be used.

Figure 2A:
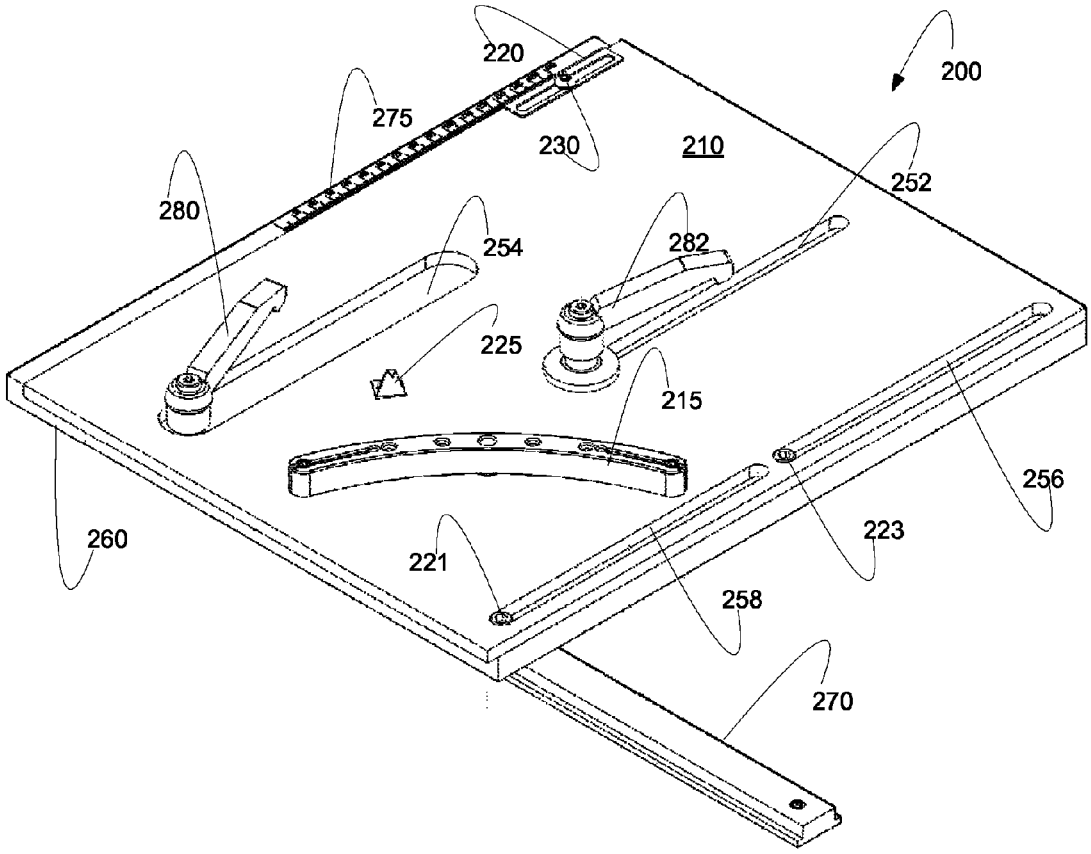
FIG. 2A depicts an embodiment of the X-Y plate assembly of Applicants' cove system.

Plate assembly 200 is shown in FIG. 2A and comprises X-plate 210 and Y-plate 260. X-plate 210 is further illustrated in FIG. 2B while Y-plate 260 is illustrated in FIGS. 2C and 2D. As can be seen in the illustrated embodiments of FIGS. 2A and 2B, in certain embodiments X-plate 210 is formed to include slots 252, 254, 258, and 256. X-plate 210 is attached to Y-plate 260 by handle 282, where handle 282 goes through slot 252 in X-plate 210 and is fixed into hole 263 of Y-plate 260. Socket head cap screws 221 and 223 are fitted into gib slots 258 and 256 and are fitted into threaded holes 262 and 261 of Y-plate 260 (FIG. 2D) respectively. In certain embodiments, an accompanying fixing washer 282.1 is used with handle 282. Slots 252, 254, 256, and 258 allow the positioning of X-plate 210 with respect to Y-plate 260 to be adjustable in the X axis. Once moved to the desired position, X-plate 210 can be secured to Y-plate 260 by tightening handle 282.

Handle 280 travels through slot 254 of X-plate 210 and passes through hole 264 (FIG. 2D) of Y-plate 260 and into threaded hole 267 (FIG. 2C) of cross slide bar 270. Handle 280 acts as a friction clamp to secure cross slide bar 270 to the machine slot in the table saw top. When in use, a set screw can be fixed into threaded hole 269 (FIGS. 2C and 2D) in cross slide bar 270 to act as a secondary friction clamp.

Figure 2B:
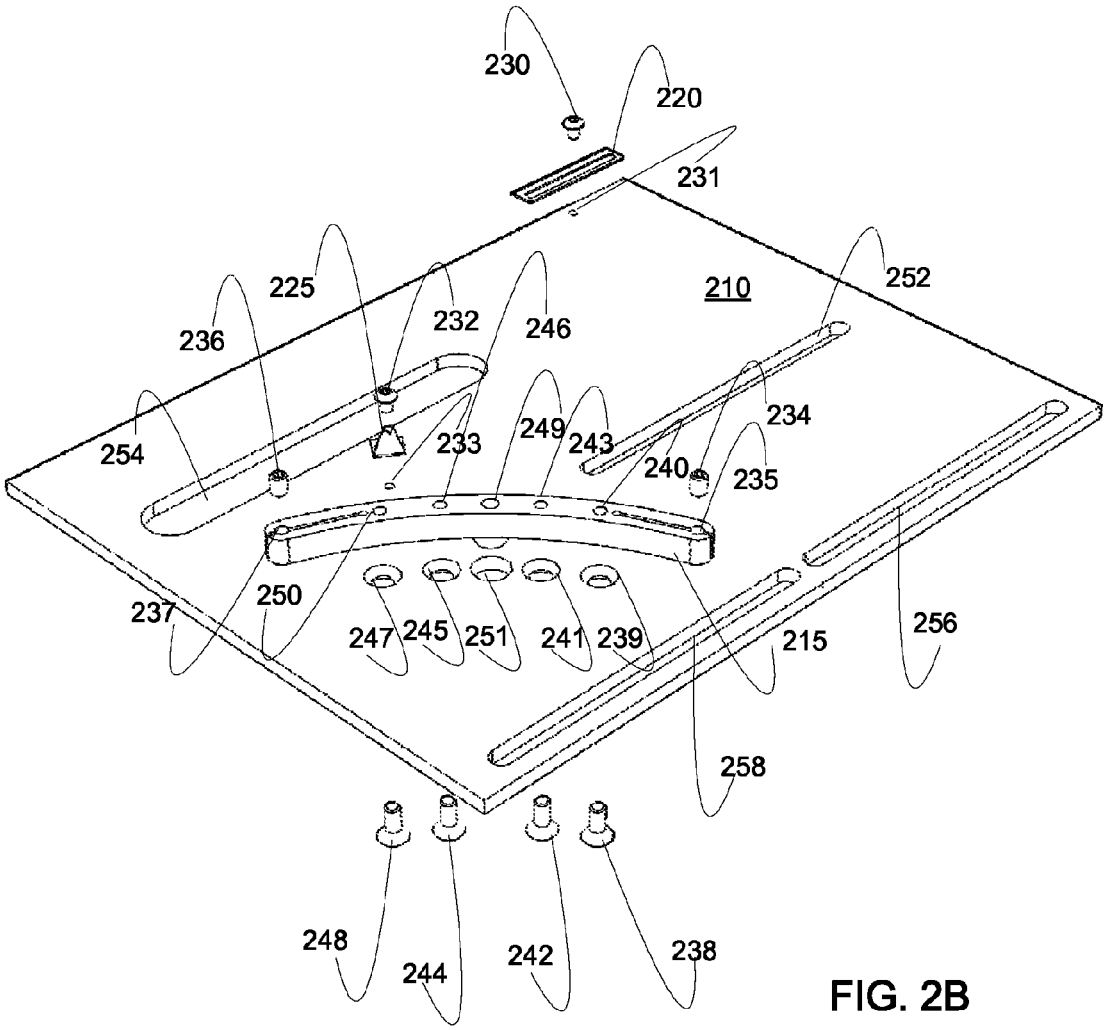
FIG. 2B depicts an exploded view of the X-plate of the X-Y plate assembly depicted in FIG. 2A.
Figure 2C:
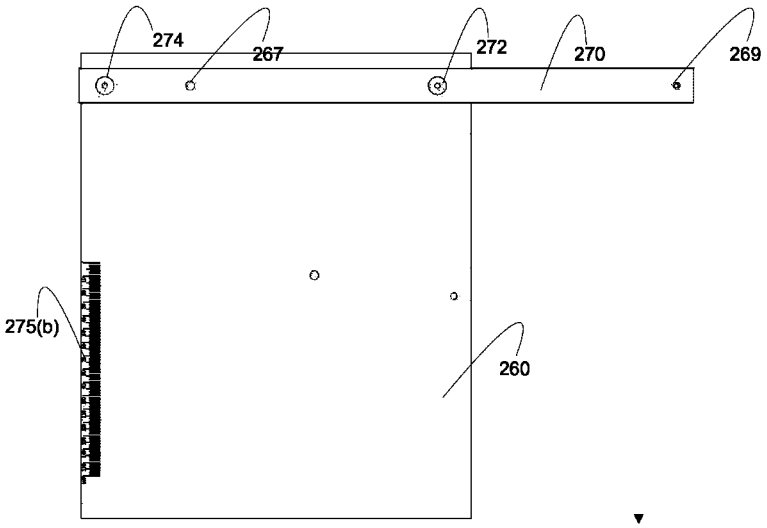
FIG. 2C depicts the Y-plate of the X-Y plate assembly depicted in FIG. 2A and the location of the cross slide bar, permitting the fixing of the system to the table saw's machine slot.
Figure 2D:
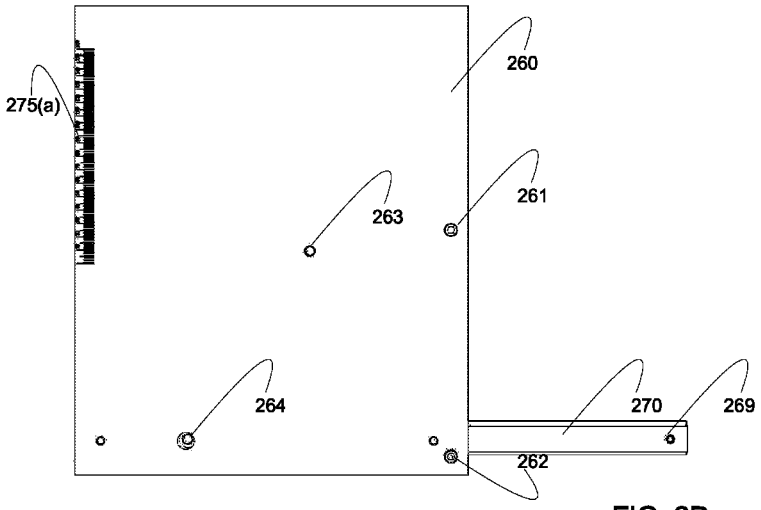
FIG. 2D depicts an alternate view of the Y-plate depicted in FIG. 2C.

As can be seen in the illustrated embodiments of FIGS. 2A and 2B, plate assembly 200 further comprises fence gib 215, fence pointer 225, and cross scale pointer 220, mounted on X-plate 210. More specifically, in certain embodiments, fence gib 215 is secured to X-plate 210 via screws 248, 244, 242, and 238 inserted through openings 247, 245, 241, and 239 and into tapped holes 250, 246, 243 and 240 respectively. Further set pins 234 and 236 are inserted into openings 235 and 237, respectively. Additionally, fence pointer 225 is secured to X-plate 210 via screw 232 inserted into tapped hole 233 and cross scale pointer 220 is secured via screw 230 inserted into tapped hole 231.

Turning now to FIGS. 2C and 2D, scale 275(*a*) and 275(*b*) are depicted on both the top and the bottom of Y-plate 260 in right handed and left handed configurations, respectively. In certain embodiments scale 275 is presented in millimeters/centimeters and/or in fractions of inches. As can be seen in FIG. 2A in certain embodiments Y-plate 260 is wider than the width of X-plate 210, such that scale 275 printed along the side of Y-plate 260 is visible below X-plate 210. In such embodiment, cross scale pointer 220 of plate assembly 200 indicates a distance on scale 275. By adjusting cross scale pointer 220, a user can calibrate the fence assembly 300 (FIG. 1A) such that fence assembly 300 is rotated by 0° (zero degrees) when split fence 311 (FIG. 1A) is parallel to and against the saw blade. A user can then record the setting of cross scale pointer 200 as part of the matrix required to reproducibly make a new custom molding.

In certain embodiments, slide bar 270 is attached to Y-plate 260 via screws 272 and 274. As will be appreciated by one of ordinary skill in the art, many table saws include a fixturing groove wherein an attachment can be secured to the table saw by sliding a slide bar of the attachment, such as slide bar 270, into the fixturing groove.

Turning now to FIGS. 1A, 3A, 3B, 3C, and 3D, Applicants' cove system 100 further comprises fence assembly 300. As can be seen in the illustrated embodiments, fence assembly 300 comprises cast fence 305 and split fence 311. Cast fence 305 further comprises protractor portion 301 and base portions 306 and 307. Protractor portion 301 includes scale 303 depicting angular units such as, and without limitation, degrees, arc-seconds, and/or radians. Protractor portion 301 is further formed to include opening 304, wherein when cove system 100 is assembled, fence gib 215 slideably fits within opening 304 such that fence assembly 300 can pivot 90° (ninety degrees) with respect to plate assembly 200. In certain embodiments, fence assembly 300 is parallel to the table saw blade at 0° (zero degrees) and is perpendicular at 90° (ninety degrees). In other embodiments, fence assembly 300 is parallel to the table saw blade at 90° (ninety degrees) and is perpendicular at 0° (zero degrees). Fence pointer 225 indicates on scale 303 the angular rotation of fence assembly 300 with respect to the table saw blade and to plate assembly 200. Once pivoted to the desired position, fence assembly 300 can be secured by tightening handle 340. Handle 340 itself is inserted through tapped hole 249 (FIG. 2B) and into clearance hole 251 (FIG. 2B) to accommodate excess thread.

As will be discussed subsequently, in certain embodiments knobs 328 and 330 are used to removeably secure auxiliary fence assembly 400 (FIGS. 4A and 4B) to split fence 311. Alternatively, in certain embodiments knobs 328 and 330 secure support rollers to split fence 311.

As can further be seen in the illustrated embodiments of FIGS. 1A, 3A, 3B, 3D, and 3F, split fence 311 comprises first portion 310 and second portion 312. This two part design of split fence 311 allows for the creation of open cove molding as well as housed and closed cove molding. As will be appreciated by one of ordinary skill in the art, in a closed cove molding the entire curve or cove cut is within the wood blank. By comparison, an open cove has an open edge. When cutting open coves, the split fence design of Applicants' cove system 100 allows split fence 311 to enclose some portion of the saw blade providing a range of movement between portions 310 and 312, and affording greater safety for the operator by minimizing the gap around the blade and increasing support surface for the work piece.

In certain embodiments, first portion 310 of split fence 311 is formed to include T-slot 313. In certain embodiments, first portion 310 is attached to base portion 306 of cast fence 305 via fence gib 316. Fence gib 316 is secured to base portion 306 using gib lock knobs 332 and 334 which compress fence gib 316 against face 321 of T-slot 313. Similarly, in certain embodiments, second portion 312 of split fence 311 is formed to include T-slot 315. In certain embodiments, second portion 312 is attached to base portion 307 of cast fence 305 via fence gib 314. Fence gib 314 is secured to base portion 307 using gib lock knobs 336 and 338 which compress fence gib 314 against face 323 of T-slot 315. This configuration allows the user to linearly adjust the position of first portion 310 with respect to base portion 306 and the position of second portion 312 with respect to base portion 307, thereby increasing or decreasing the spacing between portions 310 and 312 to safely accommodate a skewed blade when making an open cove cut. In certain embodiments, portions 310 and 312 can be moved up to six (6) inches apart. In certain embodiments, portions 310 and 312 can be moved more than six (6) inches apart. In certain embodiments, portions 310 and 312 can be moved less than six (6) inches apart.

In certain embodiments, first portion 310 and second portion 312 of split fence 311 are formed to further include vertical support roller T-slots 317 and 319 respectively. In such embodiments, vertical support rollers, such as vertical support rollers 430, 432, 434, and 436 (FIG. 4A), can be fitted within T-slot openings 317 and 319 to provide an added measure of safety when running vertically oriented curved material. Vertical support rollers 430, 432, 434, and 436 are fixed or adjusted by integral screws of the vertical support rollers which attach the vertical support rollers to vertical support roller gibs 429, 431, 433, and 435. The use of support rollers is discussed in detail below.

Figure 3A:
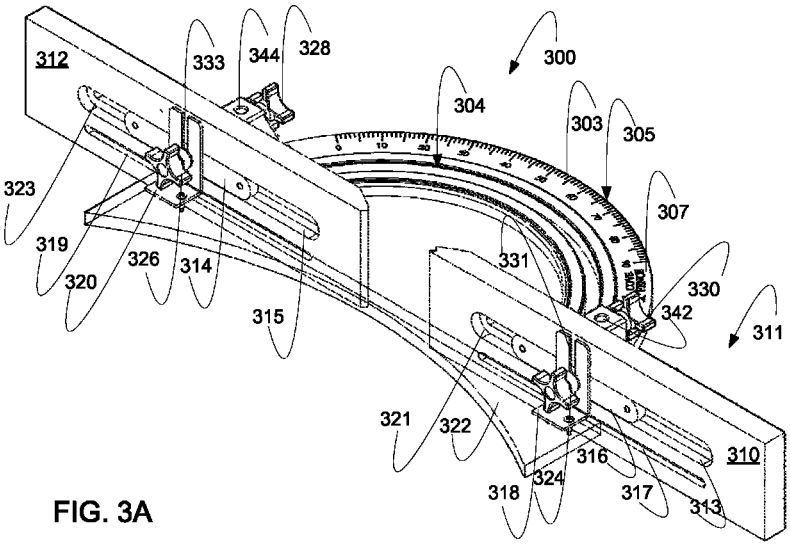
FIG. 3A depicts an embodiment of the fence assembly of Applicants' cove system showing the radius pattern system attached to the fence assembly.
Figure 3B:
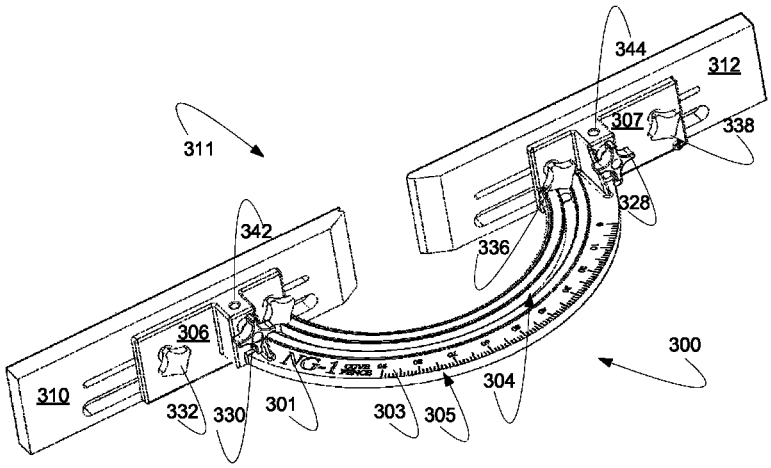
FIG. 3B depicts an alternate view of the fence assembly depicted in FIG. 3A illustrating the locking knob locations for the movable fence and the two locking knobs to accommodate the auxiliary fence.
Figure 3C:
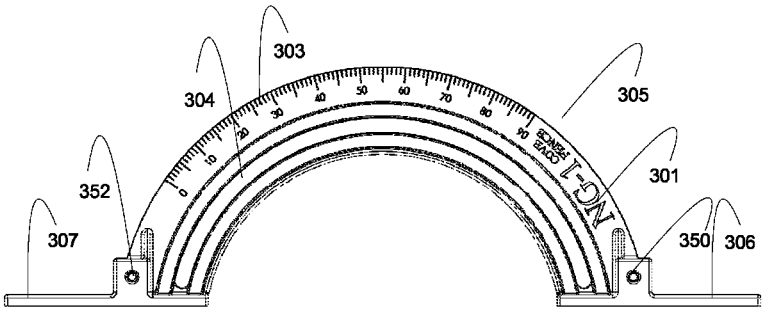
FIG. 3C depicts an embodiment of the cast fence of the fence assembly depicted in FIG. 3A.
Figure 3D:
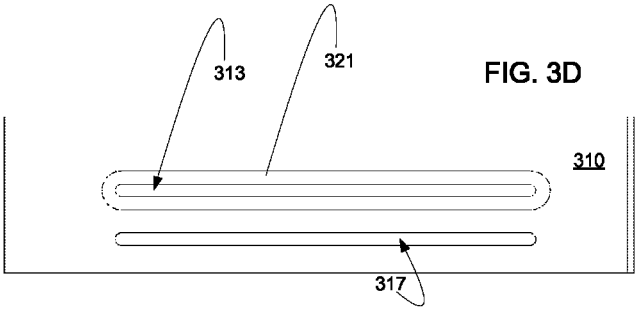
FIG. 3D depicts an embodiment of a first portion of the split fence of the fence assembly depicted in FIG. 3A.
Figure 3E:
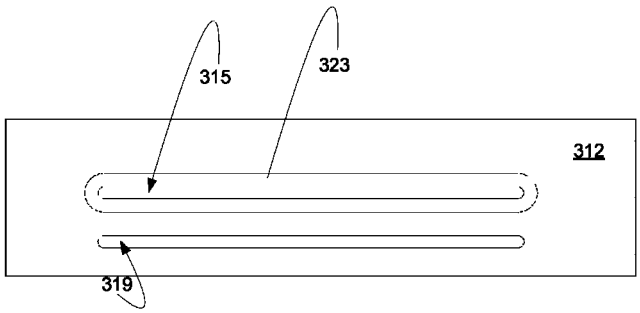
FIG. 3E depicts an embodiment of a second portion of the split fence of the fence assembly depicted in FIG. 3A.
Figure 3F:
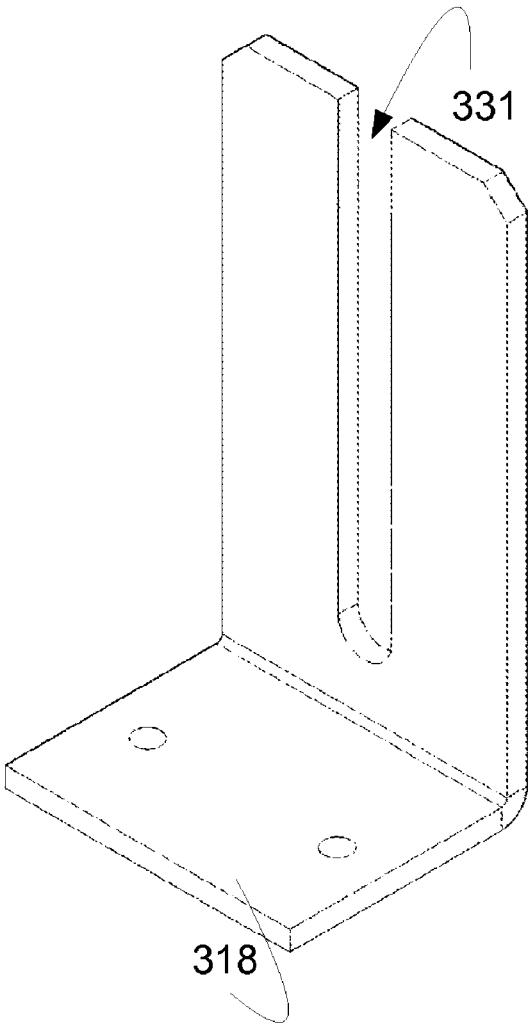
FIG. 3F depicts a pattern mount that can be used to attach a pattern to the fence assembly depicted in FIG. 3A.

As can be seen in FIGS. 3A and 3F, in certain embodiments fence assembly 300 further includes pattern mounts 318 and 320 which are attached to fence gibs 316 and 314, respectively. In such embodiments, pattern mount 318 is secured to fence gib 316 via pattern mount knob 324, which is screwed into threaded hole 327, located in the center of fence gib 316 (FIG. 1B). Similarly, pattern mount 320 is secured by pattern mount knob 326 which is screwed into threaded hole 329 in the center of fence gib 314 via pattern mount knob 326, which is screwed into threaded hole 329. In certain embodiments, pattern mount 318 is formed to include adjustment slot 331 and pattern mount 320 is formed to include adjustment slot 333. In such embodiments, pattern mount knobs 324 and 326 fit within adjustment slots 331 and 333 respectively, and can be tightened to secure pattern mounts 318 and 320 at adjustable heights to fence gibs 314 and 316 in wood fence sections 310 and 312 of split fence 311. Affixing the pattern mounts to threaded holes 327 and 329 of fence gibs 316 and 314, respectively, insures the distance of the pattern mounting holes will always be constant, and allows user supplied curve patterns to be mounted with the apex of the pattern's curve centered on the face of fence casting 300, regardless of position of fence members 310 and 312.

Once attached to fence gibs 314 and 316, pattern mounts 318 and 320 can then be attached to a pattern, such as pattern 322. In certain embodiments, pattern mounts 318 and 320 are attached to a pattern via pan-head or equivalent screws, as shown in FIG. 3A. As will be discussed subsequently, when producing curved cove and multi profile cove moldings using Applicants' cove system 100, a pattern of the same radius as the outside curve of the molding is used to assist in guiding the molding over each pass of the saw blade, with a greater measure of safety and stability. The pattern can be cut from a separate piece of wood from the molding blank or, if care is taken when cutting the curved molding blank, the fall-off may be used as the pattern.

Figure 5:
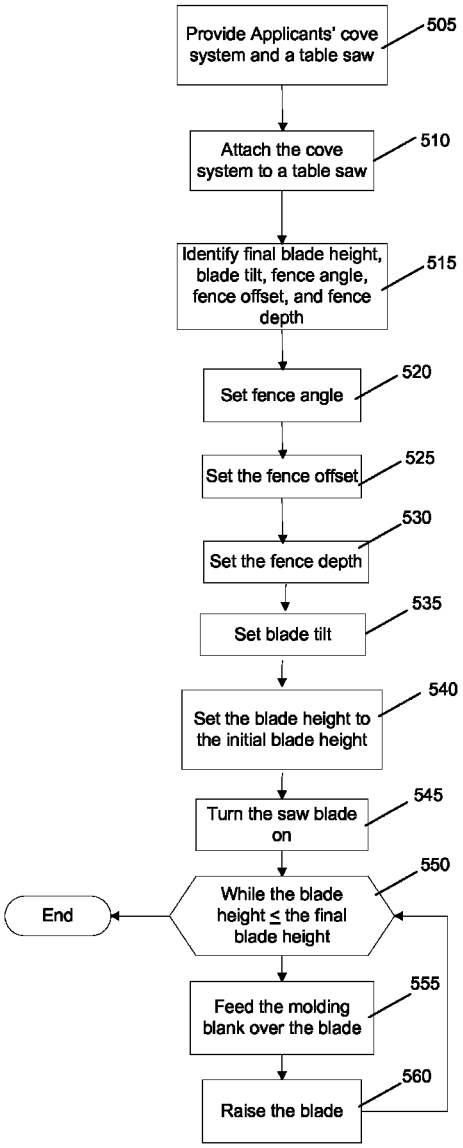
FIG. 5 is a flow chart depicting an embodiment of a method for using Applicants' cove system.

Turning now to FIG. 5, a method for using Applicants' cove system to make a straight cove molding is provided. As can be seen in block 505 of FIG. 5, Applicants' cove system and a table saw is provided. Next, as indicated by block 510, the cove system is affixed to the table saw by sliding a T-type bar of the cove system, such as slide bar 270 (FIG. 1A), into a fixturing grove on the table saw.

Next, the values of the final blade height (BH), fence angle (FA), fence offset (FO), and fence depth (FD) are identified, as indicated in block 515. In certain embodiments, an additional variable, blade tilt, is also identified. As will be appreciated by one of ordinary skill in the art, where a user is attempting to reproduce a molding that was originally made using Applicants' invention, identifying the values for each variable is simply a matter of looking up the settings used to create the original molding. When making a new, custom molding for the first time, however, the values for the final blade height (BH), fence angle (FA), fence offset (FO), fence depth (FD), and blade tilt are generally not identified before hand. In such a situation then, at block 515, a user identifies initial values for each variable based on an understanding of the relationship of the variable to the final product and the profile the user is attempting to achieve. Each variable may then be adjusted as the molding is being made until the user is satisfied with the profile being made. The final settings should be recorded and retained by the user so that the custom molding can be easily reproduced at a later time by looking up the values and setting the variables accordingly.

Figure 6:
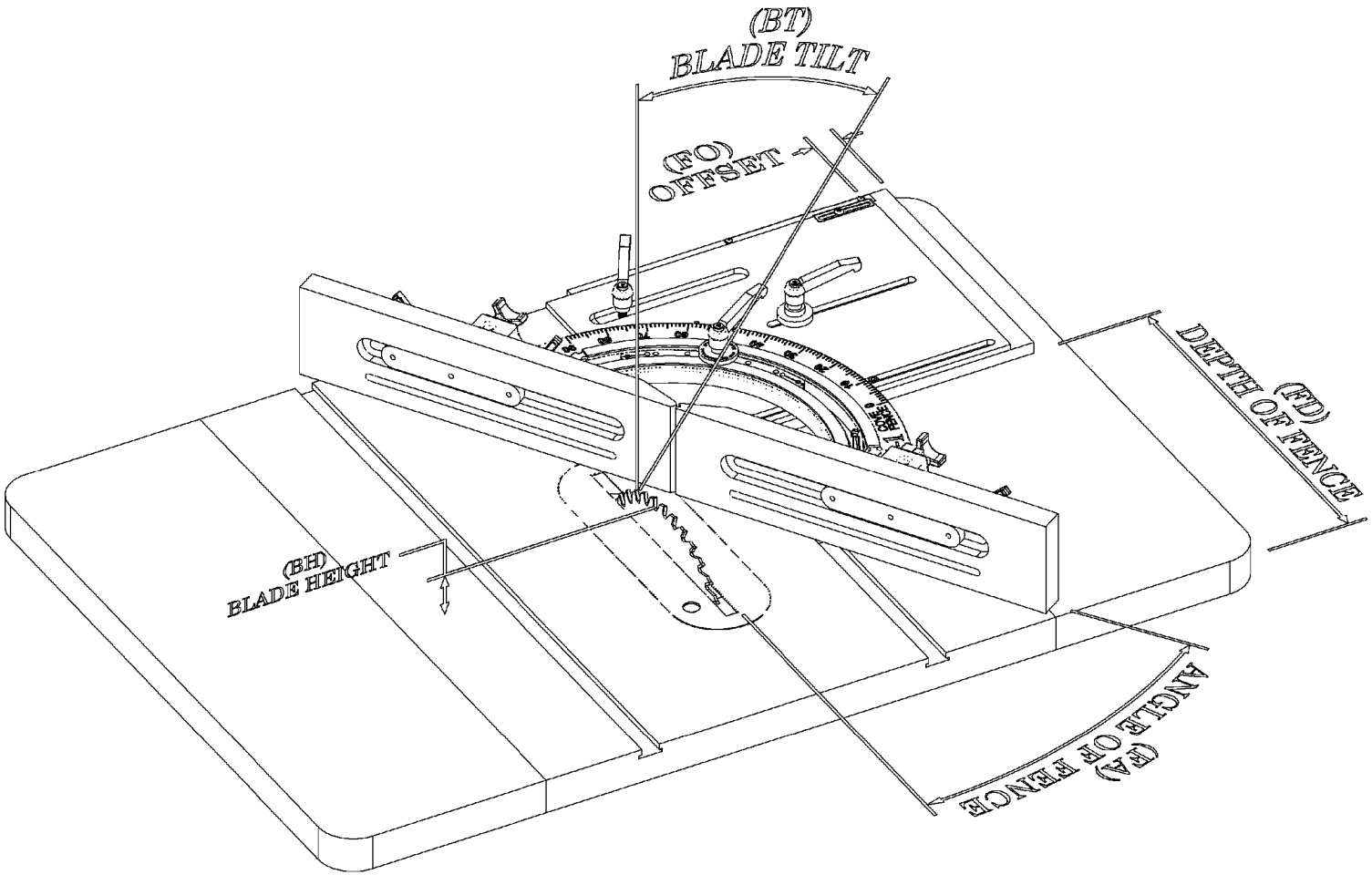
FIG. 6 depicts the relationship of the fence offset, depth of fence, fence angle, and blade height with respect to Applicants' cove system and a table saw.

The relationship of each primary variable with respect to Applicants' cove system and the table saw are shown in FIG. 6. The final blade height (BH), fence depth (FD), fence offset (FO), and fence angle (FA) determine the profile of the cove molding shape. With different combinations of these primary variables a wide variety of profiles can be created.

Figure 7A:
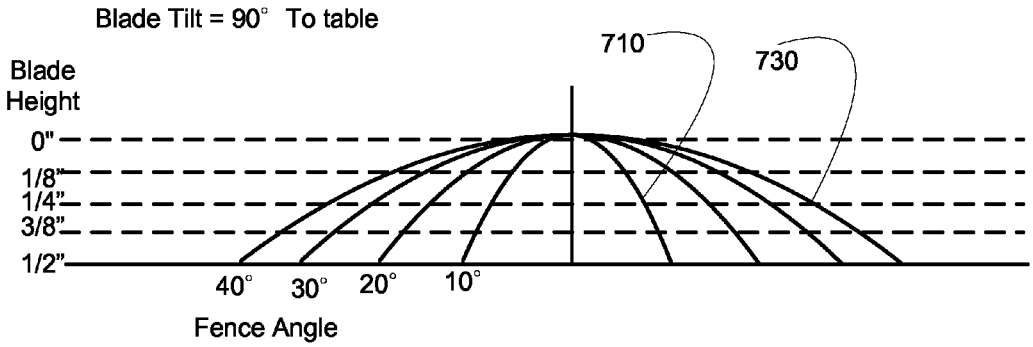
FIG. 7A depicts the relationship between the final blade height and fence angle.

FIG. 7A depicts the relationship between the final blade height (BH) and fence angle (FA). The fence angle is sometimes referred to as the "feed angle" and is the angle at which the molding blank will be fed across the saw blade. As can be seen in the illustrated embodiment of FIG. 7A, a smaller fence angle cuts a compact, elliptical cove. Conversely, greater fence angles broaden the curve to a near semi-circular profile. The final blade height determines the depth of the cove. As the diameter of the blade itself affects the maximum possible blade height, the maximum possible depth of the final cove can be increased by using a larger diameter blade or decreased by using a smaller diameter blade. In certain embodiments, Applicants' cove system 100 is designed to utilize 7-¼, 8, 9, and 10 inch diameter table saw blades. A 7-¼ inch diameter blade will yield the smallest relationship between effective blade width (fence angle) and blade height. Conversely a 10 inch blade provides the largest relationship between effective blade width (fence angle) and blade height.

Figure 7B:
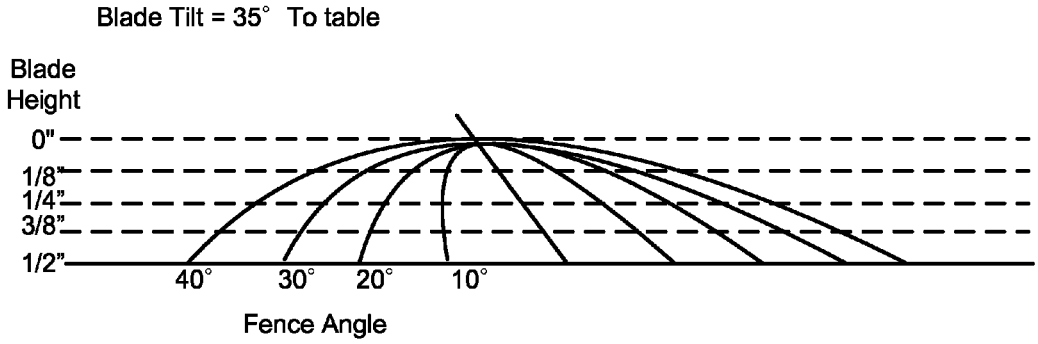
FIG. 7B depicts the relationship between the final blade height and fence angle when the blade is tilted thirty five degrees.

The effect of the blade tilt on the cove profile is shown in the contrast between FIG. 7A and FIG. 7B. In FIG. 7A the blade tilt is set to 90° (ninety degrees) with respect to top of the saw table. As can be seen in FIG. 7A, a blade tilt of 90° (ninety degrees) results in a symmetrical cove (a hyperbolic function) irrespective of fence angle (FA). By comparison, tilting the saw blade results in an asymmetrical parabolic cove that leans to one side. FIG. 7B illustrates the profile of a cove when the blade tilt is at 35° (thirty five degrees).

The fence offset and fence depth are used for recording and resetting the shoulder width required to reproducibly make custom molding profiles. The shoulder width is the distance from the interior edge of the cove cut and the nearest outside edge of the blank. Once the fence angle (FA) is determined and set, the shoulder width can be determined from the distance between the inside edge of a saw tooth on the back of the saw blade where the blade intersects the table and a line drawn perpendicular to the face of the fence. The shoulder width can be adjusted by the user by increasing or decreasing the fence depth (FD).

Returning to FIG. 5, the fence angle (FA), fence offset (FO), blade height (BH), and initial blade height are set, as indicated by blocks 520, 525, 530, 535, and 540. The fence angle (FA) is set using scale 303 (FIG. 1A) on cast fence 305 (FIG. 1A). Specifically, cast fence 305 is rotated on fence gib 215 (FIG. 1A) until fence pointer 225 (FIG. 1A) points to the desired angle setting. Once positioned, handle 340 (FIG. 1A) is used to lock the cast fence in place.

The fence depth (FD) is set by the position of the slide bar of Applicants' cove system within the T-slot groove of the table saw. By sliding the slide bar within the T-slot groove, the distance between the fence face and the saw blade, the fence depth (FD) can be increase or decreased, or housed around either side of the blade. The fence offset (FO) is set using scale 275 (FIG. 1A) and cross scale pointer 220 (FIG. 1A) of Y-plate 260 (FIG. 1A) to adjust the positioning of X-plate 210 (FIG. 1A) relative to Y-plate 260. Once set, handle 282 (FIG. 1A) is used to lock X-plate 210 in place.

How the initial blade height is set for a particular table saw is outside the present discussion but will be known to one of ordinary skill in the art. The initial blade height itself is generally one-eighth inch but, in certain embodiments, can be greater or less for specific applications, such as where the density of the wood or the width of the cut is a consideration. Such knowledge is held by one of ordinary skill in the art.

Once the fence angle (FA), fence offset (FO), fence depth (FD), and initial blade height (IBH) are set, the saw can be turned on, as indicated by block 545. The cove is then cut by repeatedly feeding the blank molding over the blade, wherein the blade is incrementally raised in-between each pass until the blade reaches the final blade height, as indicated by blocks 550, 555, and 560. By "feeding" Applicants mean the process whereby the blank molding is carefully moved over the blade such that the blade removes a portion of the stock. In the preferred embodiment, the blade height is increased by one-sixteenth of an inch between each pass. In certain embodiments, the blade height is increased by an amount greater than one-sixteenth of an inch between each pass. In certain embodiments, the blade height is increased by an amount less than one-sixteenth of an inch between each pass. In certain embodiments, the amount the blade height is increased between each pass of the molding varies.

As stated, FIG. 5 provides the method of setting-up Applicants' cove system and making a straight cove molding. An illustration of a straight, vertical cut cove molding is provided in FIG. 8A. Producing curved cove molding such as shown in FIG. 8B requires the use of a pattern having the same radius as the outside curve of the molding to be produced. As discussed in connection with FIGS. 3B and 3F, once made, the pattern is attached to Applicants' cove system using pattern mounts 318 and 320. The process of creating a curved cove or a multi-profile cove then proceeds as shown in FIG. 5 and with the pattern providing a guide for the radiused blank as it is horizontally fed over the blade.

Large or deep profile moldings, such as shown in FIG. 8C, can be produced using Applicants' cove system with the addition of an auxiliary vertical fence assembly. One embodiment of such a vertical fence assembly 400 is illustrated in FIGS. 4A and 4B. As can be seen in FIGS. 4A and 4B, the auxiliary vertical fence assembly 400 attaches to fence assembly 300 via attaching rods 412 and 418. Specifically, attaching rods 412 and 418 are inserted into openings 342 and 344 formed in base portions 306 and 307 respectively. Support rod knobs 328 and 330 fix attaching rods 412 and 418 to fence assembly 300. The auxiliary vertical fence is mounted to attachment rods 412 and 418 by brackets 407, 409, 413, and 415. In the illustrated embodiments of FIGS. 4A and 4B, attaching rods 412 and 418 are further releaseably secured to fence 401 by brackets 407, 409, 413, and 415 and held in place by lock knobs 408, 410, 414, and 416.

In certain embodiments, auxiliary vertical fence assembly 400 is further used as a stable platform for machining tall materials on edge, such as wide panels and tenons. In such embodiments, auxiliary vertical fence assembly 400 is set parallel to the saw blade.

In certain embodiments, fence feed rollers are used with fence assembly 400 to provide an additional measure of safety and stability when creating large profile coved moldings. The illustrated embodiments of FIGS. 4A and 4B show four vertical fence support rollers: rollers 434, 436, 430, and 432, being used with vertical fence 400. In such embodiments, fence 401 is formed to include T-slot shoulders 420, 422, 424, and 426. As can be seen in FIG. 4A, T-slot shoulders 420, 422, 424, and 426 connect with T-slots 440, 442, 444, and 446 respectively, wherein T-slots 440, 442, 444, and 446 are wider than the T-slot shoulders 420, 422, 424, and 426. Vertical support rollers are fixed in place with a shouldered socket head cap screw which threads into vertical roller gibs 429, 431, 433, and 435. As will be appreciated, this configuration allows for linear movement of the vertical support rollers along T-slots 440, 442, 444, and 446.

One of ordinary skill in the art will appreciate that the positioning and number of the fence feed rollers shown in FIGS. 4A and 4B is meant to be illustrative and not limiting. In other embodiments, more than four fence feed rollers are used. In yet other embodiments, less than four fence feed rollers are used. One of ordinary skill in the art will appreciate that the exact number and positioning of the fence feed rollers depends on the profile and size of the molding being created. Additionally, when needed for support, vertical fence support rollers may also be mounted on portions 310 and 312 of split fence 311 using T-slots 317 and 319.

Figure 9A:
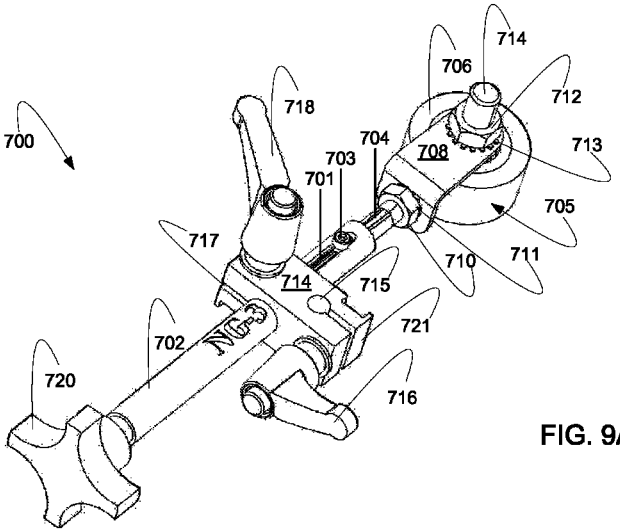
FIG. 9A depicts an optional pressure roller that may be used with Applicants' cove system.

In certain embodiments, a pressure roller, such as pressure roller 700 shown in FIG. 9A, may be used with Applicants' vertical fence assembly 400 for an added margin of safety. As can be seen in the illustrated embodiment of FIG. 9A, pressure roller 700 comprises compression spring retaining cylinder 702, piston 704, attaching means 721, and wheel assembly 705. As can be further seen, compression spring retaining cylinder 702 is hollow and the dimensions of piston 704 are such that piston 704 fits within compression spring retaining cylinder 702. The travel of piston 704, as it extends out of compression spring retaining cylinder 702, is limited by roll pin 703 captive in slot 701 of compression spring retaining cylinder 702. The pressure of the compression spring located in compression spring retaining cylinder 702 can be adjusted by turning knob 720.

One end of piston 704 is threaded (not shown) and is secured to wheel mounting plate 708 by nut 710 on each side of wheel mounting plate 708. In certain embodiments, nut 710 is a hex nut. In certain embodiments, hex nut 710 is used with external tooth lock washer 711. By an external tooth lock washer Applicants mean a washer with external 'teeth' that prevent nuts and bolts from backing out. In other embodiments, nut 710 is a k-lock nut, also sometimes referred to as a kept nut. As will be appreciated by one of ordinary skill in the art, a k-lock nut is a nut with an attached free-spinning external tooth lock washer. In certain embodiments, nut 710 is a type of nut other than a hex nut or a k-lock nut.

Wheel mounting plate 708 is further attached to axle 714 via nut 712. As with nut 710, in certain embodiments nut 712 may be a hex nut and may be used with or without external tooth lock washer 713. In other embodiments, nut 712 is a kept nut. In yet other embodiments, nut 712 is a type of nut other than a hex nut or a k-lock nut.

In certain embodiments, wheel assembly 705 is a wheel, mounted upon either a bearing, a bushing, or some other form of hub. In other embodiments, the wheel assembly 705 is a pre-manufactured roller system. In certain embodiments a bearing is used to connect axle 714 and wheel 706. In such embodiments, the bearing may be a free-wheeling bearing, meaning the wheel is able to rotate in two directions. Alternatively, in such embodiments, the bearing may be a one-way, or Sprague-type bearing. When a one-way bearing is used, Applicants' pressure roller 700 adds an additional margin of safety when used with vertical fence assembly 400 as pressure roller 700 would inhibit the movement of the molding blank in a backwards direction.

Figure 9B:
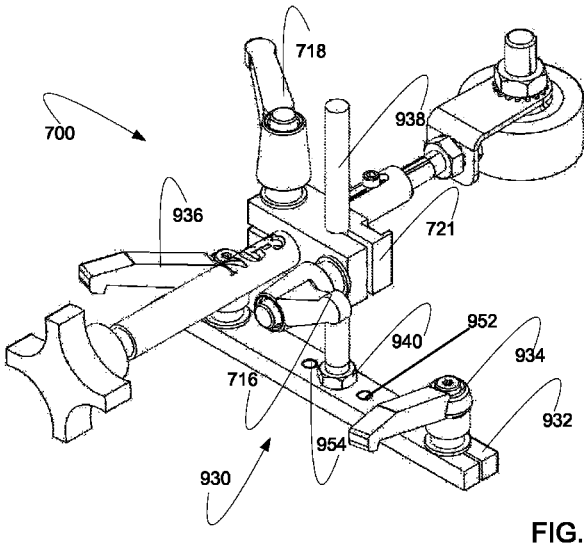
FIG. 9B depicts the pressure roller of FIG. 9A mounted on a table support fixture.
Figure 9C:
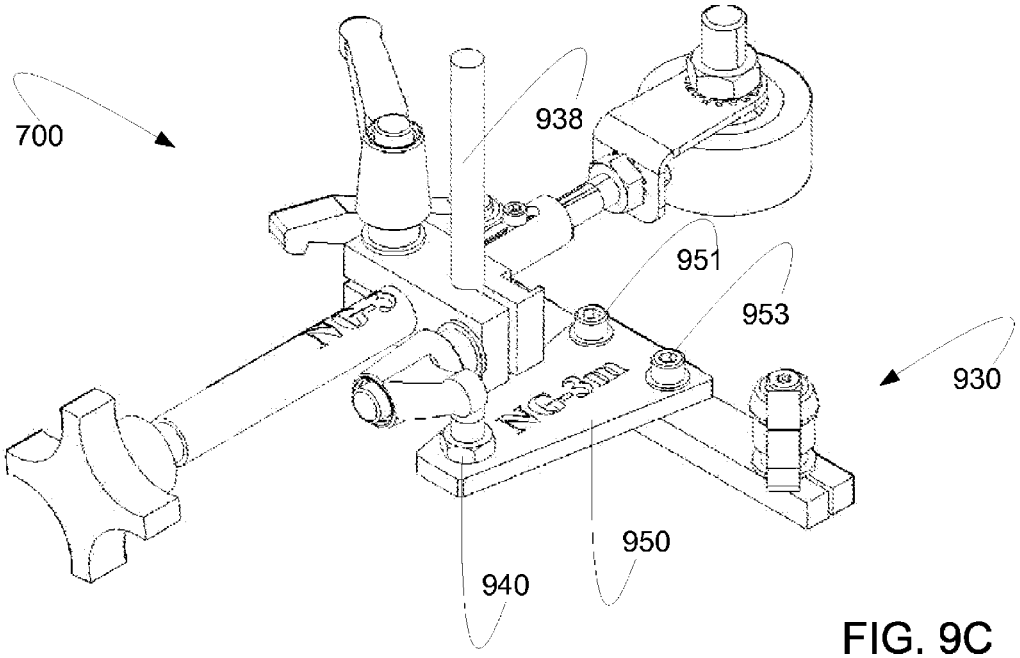
FIG. 9C depicts an alternative embodiment of FIG. 9B allowing the production of moldings of a wider width using the pressure roller of FIG. 9A.

Compression spring retaining cylinder 702 further passes through slotted opening 717 formed in clamping member 721. Compression spring retaining cylinder 702 is then fixed in place through compression by tightening handle 718. Turning to FIG. 9B, clamping member 721 is used to mount pressure roller 700 using fence mounting system 930. As can be seen in FIG. 9B, in one embodiment, fence mounting system 930 comprises bar 938 attached to base 932 via nut 940 and handles 934 and 936. Turning to FIG. 9C, in certain embodiments, fence mounting system 930 further includes extending member 950 attached to base 932 via screws 951 and 953 inserted into threaded holes 954 (FIG. 9B) and 952 (FIG. 9B). In such embodiments, bar 938 is attached to extending member 950 by nut 940. As will be appreciated by one of ordinary skill in the art, extending member 950 allows for greater flexibility in positioning pressure roller 700 with respect to Applicants' cove system 100.

To attach pressure roller 700 to a table saw using mounting system 930, bar 938 is inserted into slotted opening 715 of clamping member 721 and fixed into place by compression provided by handle 716. Base 932 is then inserted into a machine slot on the table saw and is fixed into place using handles 934 and 936.

In other embodiments, pressure roller 700 is mounted onto fence assembly 300. In such embodiments, one end of attaching rod 412 (FIG. 4B) is inserted into opening 342 (FIG. 3B) formed in base portion 306 and secured in place using knob 330. The other end of attaching rod 412 is then inserted into opening 715 and secured using knob 716. Alternatively, in other such embodiments pressure roller 700 is mounted onto base portion 307 by inserting one end of attaching rod 418 (FIG. 4B) into opening 344 (FIG. 3B) and secured using knob 330.

Figure 10:
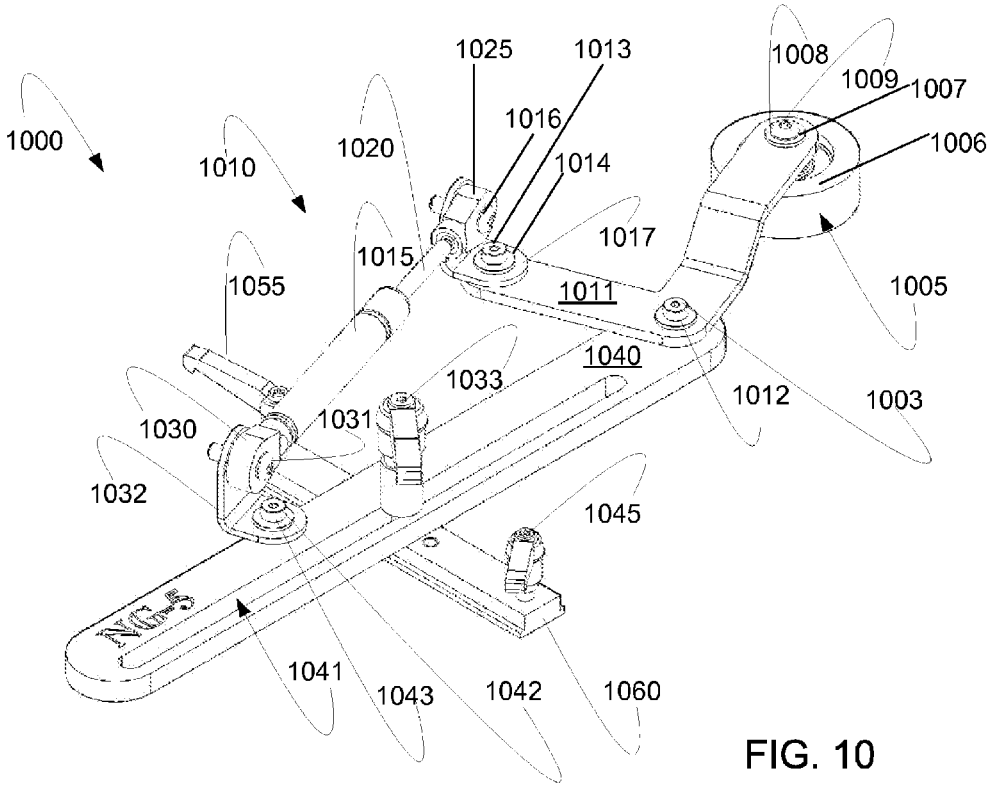
FIG. 10 depicts an optional heavy duty pressure roller that may be used with Applicants' cove system, or else for heavy milling on a table saw, spindle shaper, or on router tables.

A second embodiment of a pressure roller is depicted in FIG. 10. Heavy duty pressure roller 1000 provides pressure in the horizontal plane through a travel of as much as two inches and is designed for demanding rip and molding operations, such as irregularly edged material. As can be seen in the illustrated embodiment of FIG. 10, heavy duty pressure roller 1000 comprises wheel assembly 1005 and piston assembly 1010, bearing linkage bar 1011, base 1040, and mounted on machine slot mounting bar 1060.

Wheel system 1005 is attached to a first end of bearing linkage bar 1011 by axle 1008 via nut 1009 and lock washer 1007. In certain embodiments, wheel assembly 1005 is a wheel, mounted upon either a bearing, a bushing, or some other form of hub. In other embodiments, wheel assembly 1005 is a pre-manufactured roller system. In certain embodiments a bearing is used to connect axle 1008 and wheel 1006. In such embodiments, the bearing may be a free-wheeling bearing, meaning the wheel is able to rotate in two directions. Alternatively, in such embodiments, the bearing may be a one-way, or Sprague-type bearing.

Actuator/dampener assembly 1010 comprises piston 1020, cylinder 1015, and connecting members 1025 and 1030. Connecting member 1025 is attached to a second end of member 1011 via right angle pivot 1017. Specifically, a first end of right angle pivot 1017 is rotatably fixed to the second end of member 1011 via shoulder screw 1013 and washer 1014. In certain embodiments a screw and hub configuration is used instead of shoulder screw 1013. A second end of right angle pivot 1017 is attached to connecting member 1025 of piston assembly 1010 via screw 1016. Connecting member 1030 further fixes actuator/dampener assembly 1010 to a first end of base 1040 via right angle pivot 1032. Specifically, a first end of attaching member 1032 is secured to connecting member 1025 via shoulder screw 1031. A second end of right angle pivot 1032 is then attached to a first end of base 1040 via shoulder screw 1042 and washer 1043. In certain embodiments a screw and hub configuration is used instead of shoulder screw 1042. A second end of base 1040 is attached to a mid point of member 1011 via shoulder screw 1003 and with washers 1012 above and below linkage arm to provide smooth rotation in the horizontal plane.

As will be appreciated, the configuration described in reference to connecting members 1025 and 1030 allows for both ends of actuator/damper assembly 1010 to freely pivot.

Base 1040 is formed to include slot 1041. Base 1040 is further connected to machine slot mounting bar 1060 by threaded stud handle 1033 inserted through opening 1041 and into machine slot mounting bar 1060. As will be apparent to one of ordinary skill in the art, the location and orientation of Heavy Duty Pressure Roller Assembly 1000 can be adjusted within the range of free motion of slot 1041. Once base 1040 is in the desired position, handle 1033 can be locked to prevent further movement of base 1040.

To mount heavy duty pressure roller 1000 to a table saw, machine slot mounting bar 1060 is inserted into a machine slot on the table saw and fixed into place using knobs 1045 and 1055. Alternatively, in certain embodiments, machine slot mounting bar 932 (FIG. 9B) is used. In such embodiments, handle 1033 replaces rod 938 (FIG. 9B) and is used to secure base 1040 to machine slot mounting bar 932. Machine slot mounting bar 932 can then be inserted into a machine slot of a table saw and secured using handles 934 (FIG. 9B) and 936 (FIG. 9B).

As will be appreciated by one of ordinary skill in the art, the use of piston assembly 1010 allows member 1011 to move as pressure is applied to wheel assembly 1005. This movement allows for consistent pressure in the horizontal plane when cutting irregular width material, and provides greater pressure and travel than that provided by pressure roller 700 (FIG. 9A-9C).

Figure 11:
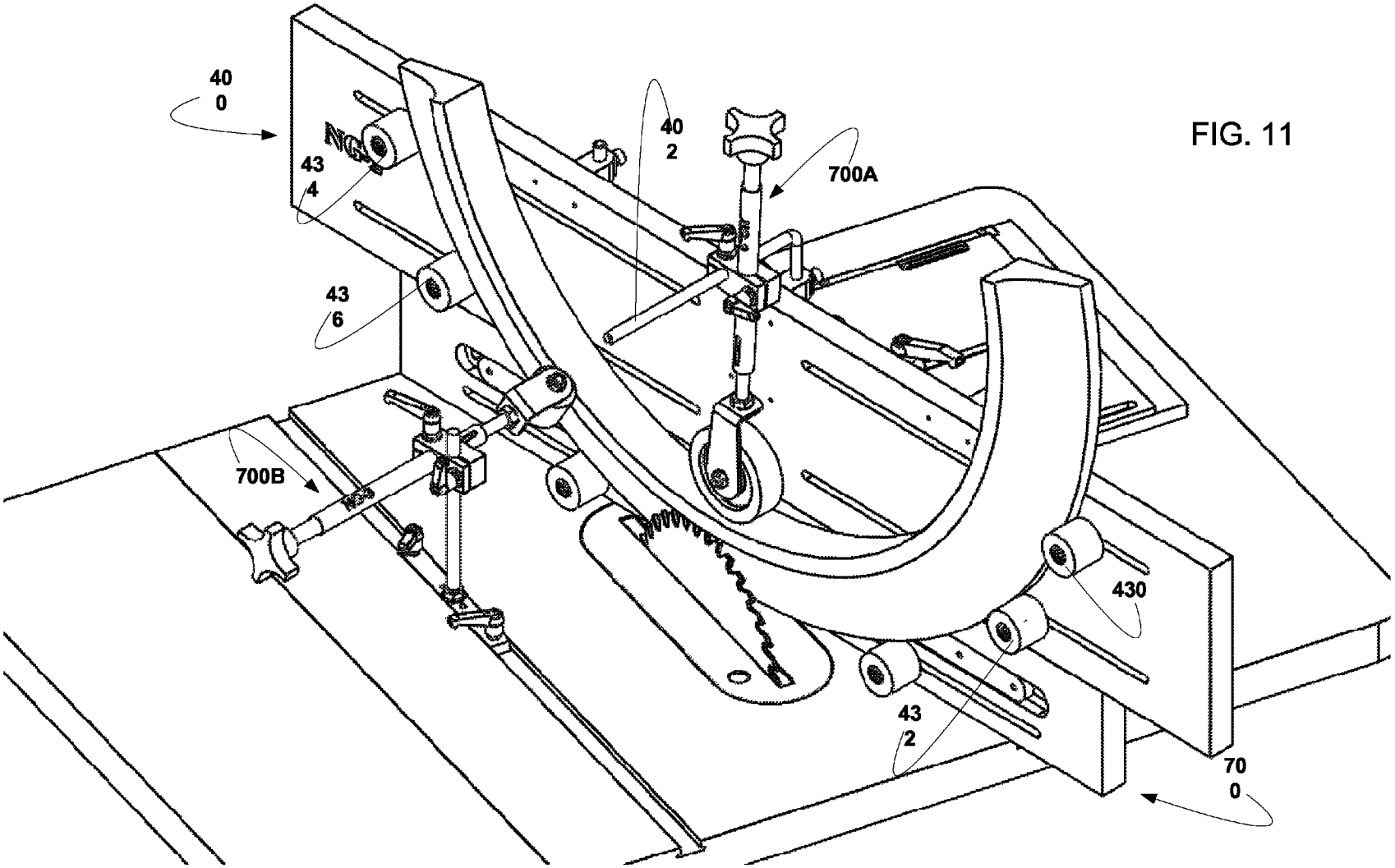
FIG. 11 is an illustration of Applicants' cove system being used with a pressure roller and an auxiliary fence with rollers to produce a large scale vertical radiused cove molding.

FIG. 11 is an illustration of Applicants' cove system 100 using optional pressure rollers 700A and 700B and optional vertical fence assembly 400 to safely cut a deep profile cove. As can be seen in the illustrated embodiment of FIG. 11, pressure roller 700A is mounted on mounting rod 402, which is secured to vertical fence assembly 400 using brackets and lock knob assemblies 404 and 406 (FIG. 4B), while pressure roller 700B affixed to the surface of the table saw. Support rollers 430, 432, 434, and 436 are affixed to vertical fence assembly 400 while additional support rollers further affixed to split fence 311 to guide the cove molding over the saw blade as it is being cut. Pressure rollers 700A and 700B, heavy duty pressure roller 1000, and support rollers all assist in insuring a non-marring, slip resistant single point contact to the material being milled, which is essential when doing any curvature work and preferable with linear work. These rollers further allow greater control and safety when working with slightly irregular, warped, or stressed material.

As will be appreciated by one of ordinary skill in the art, pressure roller 700 and heavy duty pressure roller 1000 can further be used without Applicant's cove system 100 in place of finger boards in a wide variety of standard milling operations using different tooling.

Furthermore, as will be appreciated by one of ordinary skill in the art, while Applicants' cove system 100 has been described and illustrated in reference to a table saw, Applicants' cove system 100 can be mounted on a router table for use with a router. Using Applicants' cove system 100 with a router allows for a variety of radius cuts on radiused pieces that would be very difficult under normal conditions.

While the preferred embodiments of the present invention have been illustrated in detail, it should be apparent that modifications and adaptations to those embodiments may occur to one skilled in the art without departing from the scope of the present invention as set forth in the following claims.

We claim:

1. A system for cutting a cove using a table saw comprising:

a first fence assembly;

a second fence assembly releasably attached to the first fence assembly such that the second fence assembly is positioned vertically above the first fence assembly; and a fixturing means rotatably affixed to the first fence assembly, wherein the fixturing means can be releasably secured to a table portion of the table saw, the fixturing means comprising:

a plate assembly comprising a fence gib rotatably affixed to the first fence assembly; and a slide bar affixed to the plate assembly, wherein the table portion further comprises a fixturing groove, wherein the slide bar can be releasably secured within the fixturing groove.

2. The system of claim 1, wherein the first fence assembly comprises a split fence having a first portion and a second portion, wherein a distance between the first portion and the second portion is adjustable.

3. The system of claim 1, wherein the first fence assembly further comprises a cast fence, wherein the cast fence comprises a scale, wherein the scale provides an angular measurement.

4. The system of claim 1, further comprising at least one support roller releasably attached to one of said first fence assembly and said second fence assembly.

5. A system for cutting a cove using a table saw comprising:
a first fence assembly;
a fixturing means rotatably affixed to the first fence assembly, wherein the fixturing means can be releasably secured to a table portion of the table saw, the fixturing means comprising:
a plate assembly comprising a fence gib rotatably affixed to the first fence assembly; and
a slide bar affixed to the plate assembly, wherein the table portion further comprises a fixturing groove, wherein the slide bar can be releasably secured within the fixturing groove; and
a pressure roller that can be releasably affixed to said table.

6. The system of claim 5, wherein the pressure roller further comprises a slide bar, wherein the table further comprises a fixturing groove, wherein the slide bar can be releasably secured within the fixturing groove.

7. A system for cutting a cove using a table saw comprising:
a first fence assembly;
a fixturing means rotatably affixed to the first fence assembly, wherein the fixturing means can be releasably secured to a table portion of the table saw, the fixturing means comprising:
a plate assembly comprising a fence gib rotatably affixed to the first fence assembly; and
a slide bar affixed to the plate assembly, wherein the table portion further comprises a fixturing groove, wherein the slide bar can be releasable secured within the fixturing groove; and
a pattern mount that is releaseably affixed to the first fence assembly.

8. A method of cutting a cove using a table saw comprising:
providing a table saw comprising a table and a saw blade;
providing a blank molding;
providing a cove system comprising:
a first fence assembly;
a fixturing means rotatably affixed to the first fence assembly, wherein the fixturing means can be releasably secured to the table; and
a second fence assembly that can be releasably attached to the first fence assembly;
releasably attaching the second fence assembly to the first fence assembly such that the second fence assembly is positioned vertically above the first fence assembly;
releasably affixing the cove system to the table;
setting a fence angle using the first fence assembly;
setting a fence depth by adjusting a position of the fixturing means with respect to the table; and
feeding the blank molding over the saw blade, thereby cutting a cove in the blank molding.

9. The method of claim 8, wherein said cove system further comprises a first vertical support roller releasably attached to said first fence assembly, the method further comprising positioning the first vertical support roller with respect to the first fence assembly.

10. The method of claim 9, wherein said cove system further comprises second vertical support roller releasably attached to the second fence assembly, the method further comprising:
positioning the second vertical support roller with respect to the said second fence assembly;
wherein said feeding the blank molding over the saw blade further comprises:
orienting the blank molding vertically; and
guiding the blank molding over the saw blade using the first vertical support roller and the second vertical support roller.

11. A method of cutting a cove using a table saw comprising:
providing a table saw comprising a table and a saw blade;
providing a blank molding;
providing a cove system comprising:
a first fence assembly;
a fixturing means rotatably affixed to the first fence assembly, wherein the fixturing means can be releasably secured to the table; and
a pressure roller that can be releasably affixed to the table;
releasably affixing the cove system and the pressure roller to the table;
setting a fence angle using the first fence assembly;
setting a fence depth by adjusting a position of the fixturing means with respect to the table; and
feeding the blank molding over the saw blade, thereby cutting a cove in the blank molding.

12. The method of claim 11, wherein the pressure roller further comprises a slide bar, wherein the table further comprises a fixturing groove; the method further comprising releasably securing the slide bar within the fixturing groove.

13. The method of claim 12, wherein said cove system further comprises a pattern mount releaseably affixed to the first fence assembly, the method further comprising mounting a pattern to the pattern mount.

* * * * *